US012173596B1

(12) United States Patent
Hunter et al.

(10) Patent No.: US 12,173,596 B1
(45) Date of Patent: Dec. 24, 2024

(54) AUTOMATIC PRESSURE TEST AND EQUALIZATION TO WELLHEAD PRESSURE

(71) Applicant: Halliburton Energy Services, Inc., Houston, TX (US)

(72) Inventors: Timothy Holiman Hunter, Duncan, OK (US); Shaun Kyle Pyka, Houston, TX (US); Gregory R. Forrest, Houston, TX (US); Mehdi Mazrooee, Houston, TX (US); Glen Leo Handke, Duncan, OK (US); Madhur Kohli, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/496,522

(22) Filed: Oct. 27, 2023

(51) Int. Cl.
*E21B 43/26* (2006.01)

(52) U.S. Cl.
CPC ..... *E21B 43/2607* (2020.05); *E21B 2200/20* (2020.05)

(58) Field of Classification Search
CPC ..... E21B 43/2607; E21B 2200/20
See application file for complete search history.

(56) References Cited

U.S. PATENT DOCUMENTS

| | | | | |
|---|---|---|---|---|
| 4,192,182 | A * | 3/1980 | Sylvester | E21B 43/2607 73/152.52 |
| 11,237,076 | B2 | 2/2022 | Mazrooee et al. | |
| 2016/0313208 | A1* | 10/2016 | Hilpert | G01M 3/2876 |
| 2017/0074748 | A1* | 3/2017 | Hilpert | G01M 3/2876 |
| 2020/0284140 | A1* | 9/2020 | Jones | G01V 9/00 |
| 2021/0063271 | A1* | 3/2021 | Mazrooee | E21B 43/26 |
| 2022/0213781 | A1* | 7/2022 | Parthasarathy | F04D 15/0088 |
| 2023/0243348 | A1 | 8/2023 | Publes et al. | |

* cited by examiner

*Primary Examiner* — James G Sayre
(74) *Attorney, Agent, or Firm* — DeLizio, Peacock, Lewin & Guerra, LLP

(57) ABSTRACT

A system and method for controlling a pumps configured to pump fluid from a fluid supply to a frac iron configuration. A pressure schedule is defined, the pressure schedule including a pumps assigned to sets of pumps, wherein each set of pumps is associated with a pressure level and wherein each set of pumps except a first set of pumps is a subset of a previous set of pumps. The first set of pumps is enabled to pump fluid continuously until the fluid in the manifold has reached a predetermined pressure level. A processor then automatically disables the electric pumps that are not in the next set of electric pumps, while allowing the next set of pumps to continue to pump fluid until the fluid in the manifold has reached the next pressure level. This continues until the manifold is at the desired pressure.

20 Claims, 5 Drawing Sheets

300

| Target Pressure, % | EPUs Disabled @ each %TP |
|---|---|
| 99% | 1 |
| 80% | 1 |
| 70% | 30% |
| 60% | 30% |
| 50% | Remaining EPUs |

302 304

FIG. 3A

310

WHEN TARGET PRESSURE (TP) = 10,000 PSI
EPUS = 20

| TP, psi | EPUs Disabled @ each %TP | # EPUs IN USE |
|---|---|---|
| 9900 | 1 | 1 |
| 8000 | 1 | 2 |
| 7000 | 6 | 8 |
| 6000 | 6 | 14 |
| 5000 | 6 | 20 |

312 314 316

FIG. 3B

AUTOMATIC PRESSURE TEST AND EQUALIZATION TO WELLHEAD PRESSURE

BACKGROUND

The oil and gas industry uses well stimulation techniques to increase the transfer of hydrocarbon resources from a reservoir formation to a wellbore. Such stimulation typically relies on the introduction of a pressurized fracturing fluid into a wellbore. The pressurized fracturing fluid generates fractures downhole in the reservoir formation. As part of the process, a flow network, sometimes referred to as "frac iron," is constructed between a plurality of pumps and a wellhead of a borehole. The flow network provides a path to deliver the pressurized fracturing fluid to the borehole so the fluid can be used to generate and stabilize fractures in the reservoir formation.

BRIEF DESCRIPTION OF THE DRAWINGS

The examples provided in the disclosure may be better understood by referencing the accompanying drawings.

FIGS. 3A and 3B illustrate example pressure schedules for the well stimulation system of FIG. 1.

Like reference numbers and designations in the various drawings indicate like elements.

DETAILED DESCRIPTION

Figure 1:
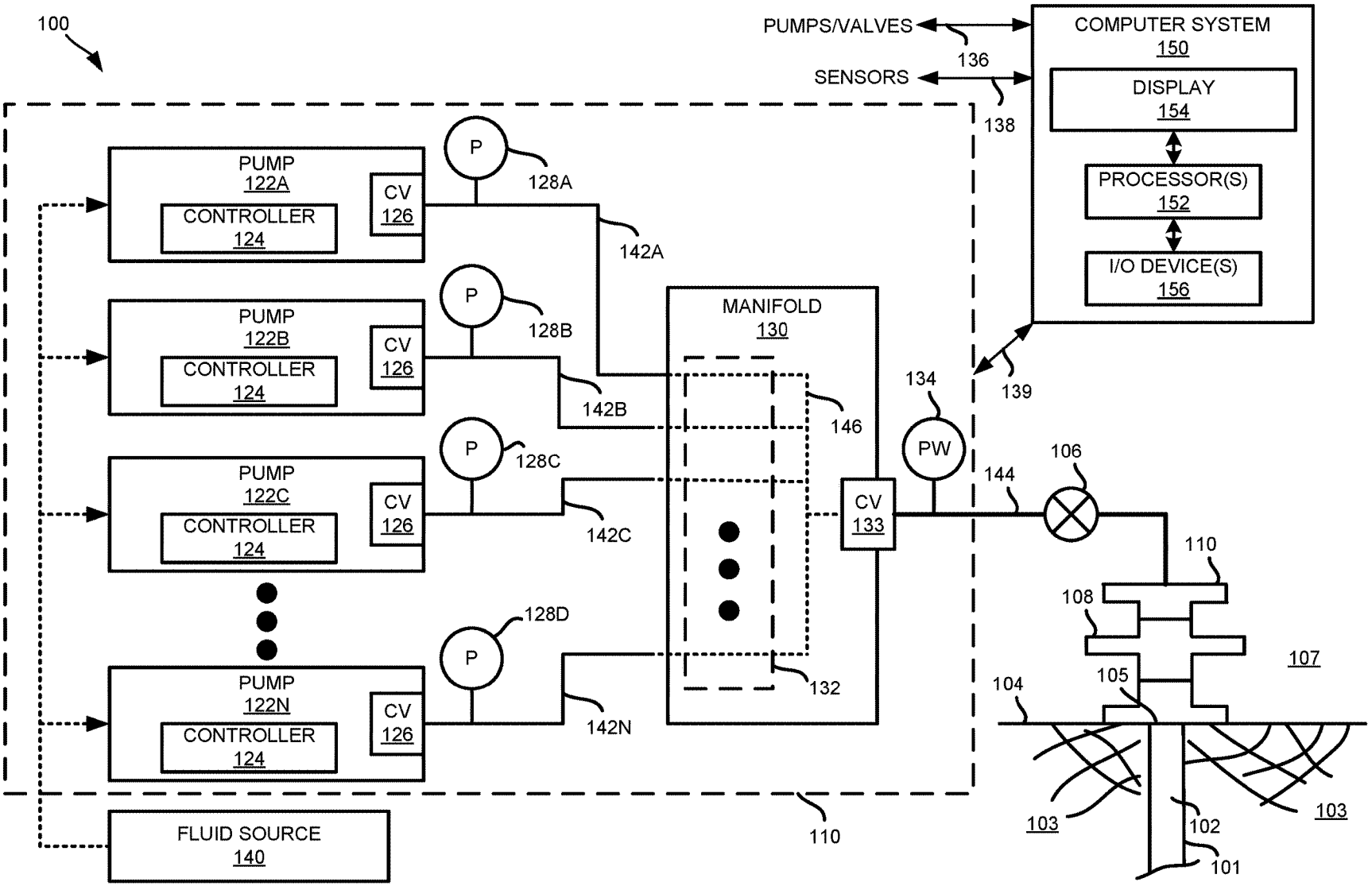
FIG. 1 is a conceptual block diagram of a well stimulation system in a wellbore environment.

The description that follows includes example systems, methods, techniques, and program flows that embody the present disclosure. Unless otherwise specified, use of the terms "connect," "engage," "couple." "attach," or any other like term describing an interaction between elements is not meant to limit the interaction to a direct interaction between the elements and may also include an indirect interaction between the elements described. Unless otherwise specified, use of the terms "up." "upper." "upward." "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

Certain aspects and features of the present disclosure relate to a well stimulation system having multiple pumps and a flow network connected to the pumps. In operation, the flow network conveys pressurized fracturing fluid from the pumps to a reservoir formation. Further aspects and features of the present disclosure relate to systems, apparatus, methods, and techniques that may be used to perform automatic pressure testing of a frac iron configuration when coupled to a well head of a borehole and to provide a flow path for a fluid, such as a fracturing fluid, to be contained and transported between a plurality of pumps and the well head. As used herein the terms "frac iron" and "frac iron configuration" may be used interchangeably; the terms refer to any set of devices arranged to provide a flow path for a fluid, such as but not limited to a fracturing fluid, between a plurality of pumps and a well head of a borehole. Frac iron may include devices such as fluid conduits (i.e., metal pipes, flexible pressure-rated hoses, etc.) arranged to provide a flow path to contain, deliver, and transport a fluid, such as a fracturing fluid, between the pumps and the well head of a borehole.

Frac iron may also include coupling devices and one or more manifolds configured to controllably couple, and in some instances de-coupled, various combination of piping and/or hoses included in the system. In one example approach, the coupling devices physically couple the various components of the frac iron together to form seals able to withstand fluid pressures present within the frac iron and/or frac iron. Frac iron may further include combinations of check valves and/or isolation valves configured to provide fluid coupling and decoupling between one or more portions of the frac iron configuration. Devices included when referring to "frac iron" or a "frac iron configuration" are not limited to devices that are formed in whole or in part of material comprising iron, or an alloy comprising iron, and may be formed from any material suitable for constructing the flow path included in the frac iron configuration.

As used herein, the phrase "automatic pressure testing" includes any type of system, apparatus, method, and/or technique that uses a computer system or other type of controller, such as but not limited to a programmable logic controller, to control at least some aspect of processes performed as part of the pressure testing of a frac iron configuration. The terms "computer system" and "controller" may be used interchangeably and may refer to any type of programmable device that receives inputs and provide outputs to control the operation of the devices described herein. The phrase "automatic pressure testing" does not require that the pressure testing procedure be completely performed by the computer system or the controller; in some example approaches, the computer system or controller interacts with and receives inputs from a human operator, such as a field technician or an engineer, before, during, and/or after the automatic pressure testing procedure is being or was performed. For example, a computer system performing an automatic pressure testing procedure on a frac iron configuration may receive input values for parameters, such as target pressurization values, evaluation time periods, and threshold bleed off pressures, as further described below, before and/or during the actual automatic pressure testing procedure. In some embodiments, at any time during an automatic pressure testing procedure when a leak in the frac iron configuration is detected, the computer system that is performing the automatic testing procedure may request and/or require an input from an operator, such as a technician or an engineer, indicating whether the automatic pressure testing procedure is to continue, and/or if one or more portions of the frac iron configuration may be isolated from additional portions of the frac iron configuration as part the continuation of the pressure testing procedure.

In general, fracturing fluids in well stimulation systems are injected into the wellbore at a high pressure in order to convey sufficient energy to a subterranean formation to cause fracturing in the formation. In some example approaches, well stimulation systems induce fluid pressures in a range of 10,000 to 20,000 pounds/square inch (psi) in the fluid injected into the wellbore.

Given the high pressures involved, it is important to ensure that the frac iron configuration safely conveys the fracturing fluid to the wellbore. In one example approach, therefore, the frac iron configuration is pressure tested before fracking fluid is injected in the well bore (i.e., before a fracking procedure begins). In some such example approaches, the testing procedure starts by closing a isolation valve at the well head to "deadhead" the pumps providing the fluid pressure to the frac iron configuration. The test procedure then runs the pumps to pressurize the frac iron configuration, and monitors changes in pressure with respect to time at one or more locations in the frac iron configuration to determine if there are any leaks in the frac iron configuration.

Embodiments of the systems, apparatus, methods, and techniques described herein may provide a more consistent and potentially safer method for pressurizing a frac iron configuration and for pressure testing such frac iron configurations. Embodiments include one or more methods for using pumps and a computer system or controller to perform automatic pressure testing on the frac iron configuration. Embodiments of the automatic pressure testing as described herein may include one or more of the following features: 1) enabling pumps from a plurality of electric pumps connected to a frac iron configuration to run continuously; and 2) automatically disabling one or more of the pumps at each predetermined evaluation pressure level based on a pressure schedule.

In some example approaches, a method for controlling a plurality of electric pumps configured to pump fluid from a fluid supply to a frac iron configuration, the frac iron configuration including a manifold connected to the electric pumps, the method including defining a pressure schedule having first, second and third sets of the electric pumps, wherein the second set is a subset of the first set and the third set is a subset of the second set; enabling the first set of electric pumps to pump fluid continuously from the fluid supply to the frac iron configuration until the fluid in the manifold has reached a first pressure level; automatically disabling the electric pumps from the first set of pumps that are not in the second set of electric pumps after reaching the first pressure level, while allowing the second set of pumps to continue to pump fluid from the fluid supply to the frac iron configuration until the fluid in the manifold has reached a second pressure level; and automatically disabling the electric pumps from the second set of pumps that are not in the third set of electric pumps after reaching the second pressure level, while allowing the third set of pumps to continue to pump fluid from the fluid supply to the frac iron configuration until the fluid in the manifold has reached a third pressure level.

In some example approaches, a well stimulation system includes a frac iron configuration and a plurality of electric pumps, the frac iron configuration having a system pressure sensor and a manifold connected via fluid lines to the plurality of electric pumps; and a computer system connected to the electric pumps and to the manifold, wherein the computer system includes a processor and a memory, wherein the memory includes instructions that, when executed on the processor, pressurize the frac iron configuration with a fluid. In some example approaches, pressurizing includes enabling each of the electric pumps to operate continuously to a first pressure level before disabling one or more of the enabled electric pumps according to a pressure schedule, operating each of the enabled electric pumps continuously to a second pressure level before automatically disabling one or more of the enabled pumps according to the pressure schedule; operating each of the enabled pumps continuously to a third pressure level before disabling one or more additional enabled pumps according to the pressure schedule.

In one example approach, a method includes automatically performing a plurality of pressurizing cycles on a frac iron configuration having a plurality of pressure sensors, each of the pressurizing cycles including pressurizing the frac iron configuration with a fluid to a predetermined evaluation pressure level using pumps in a predefined pump configuration, the predefined pump configuration defined in a pressure schedule, pausing the pumps for a predetermined amount of time. when the fluid in the manifold has reached one of the pressure levels in the pressure schedule, automatically switching the pumps to the predefined pump configuration associated with the next higher pressure level.

In various embodiments, at each of the predetermined evaluation pressures, an acceptable bleed off rate is calculated from one or a combination of parameters, including but not limited to: the number of pumps operating, the pumping horsepower, the volume in the tubing of the frac iron, the fluid in the tubing of the frac iron, the compressibility of the fluid, the dimensions of the tubing included in the frac iron, the applied pressure, and/or the stretch in the tubing included in the frac iron. In various embodiments, pumping may be stopped during each of the evaluation time periods used to monitor for bleed off of the fracturing fluid pressure once the frac iron configuration has been pressurized to any one of the predefined evaluation pressures. In various embodiments, some positive integer number of pressure testing cycles are performed, each pressure testing cycle performed at an increasingly higher predetermined evaluation test pressure, in a stepwise fashion up to and in some instances including a pressure testing cycle performed at the maximum pressure rating determined for the frac iron configuration being tested.

Embodiments of the methods and techniques described herein allow for automatic pressure testing using stepped pressure increases, which may include an algorithm for determining factors such as the compressibility of the fluid and the metal stretching of the devices including in the frac iron configuration. The use of the stepped pressure increases may allow for leaks in the frac iron to be detected earlier and at lower fluid pressure, thus increasing the overall safety of the pressure testing process. Additionally, the systems, apparatus, methods, and techniques described herein assures that the pressure limits for the frac iron configuration are maintained and that maximum pressure ratings are not exceeded. Because it is often easy to exceed the pressure limits during manual leak testing, especially as additional pumps are added to the process, embodiments of the automatic pressure testing procedure as described herein may provide an additional level of safety compared to manual leak testing procedures. Further, embodiments of the automatic pressure testing as described herein may provide more accuracy and more safety for the pressure testing procedures, and which may be performed more quickly relative for example to manual or other testing procedures.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 illustrates a conceptual block diagram of a well stimulation system 100 in a wellbore environment in which pressure testing apparatus, methods, and systems may be deployed in accordance with embodiments of the disclosure. Well stimulation system 100 may be configured to perform automatic pressure testing procedures on a frac iron configuration 110 in a wellbore environment. In the example shown in FIG. 1, well stimulation system 100 includes a frac iron configuration 110; the frac iron configuration 110 is attached to a well bore 102. In some examples, well stimulation system 100 may also include a computer system 150.

As shown in FIG. 1, a wellbore includes a borehole 102 extending from a surface 104, such as the earth's surface, and downward into a formation 103. The borehole 102 may include a casing 101 that encloses at least some portion of the borehole 102 extending from surface 104 into a formation 103 to some depth extending away from a top opening 105 of the borehole 102 at the surface 104. A wellhead 108 comprising one or more connections may be positioned at the top opening 105 and arranged to couple to the casing 101 and thus seal off the borehole 102 relative to the area 107 above surface 104. In some example approaches, wellhead 108 includes a wellhead valve 110.

Well stimulation system 100 may include N pumps 122 connected to a manifold 130 through individual pump lines 142. In one example approach, the manifold 130 is configured to couple the pump lines 142 from respective pumps 122 to a main line 144 extending from the manifold 130 through an isolation valve 106 to wellhead 108. In another example approach, the manifold 130 is configured to couple the pump lines 142 from respective pumps 122 to a main line 144 extending from the manifold 130 to a wellhead valve 110 in wellhead 108. In yet another example approach, isolation valve 106 is used with wellhead valve 110 to isolate the borehole from area 107 and to isolate a portion of line 144 from the manifold 130 and the wellhead 108. In yet another embodiment, isolation valve 106 is used to isolate pumps and main manifold and a portion of line 144 from the wellhead 108.

In the example shown in FIG. 1, frac iron 110 includes pumps 122A through 122N, pump lines 142A through 142N and manifold 130. Manifold 130 is configured to controllably couple pump lines 142 individually, or in any combination, to the pump main line 144, as illustratively shown by internal flow network 146. Pumps 122, pump lines 142, manifold 130 and pump main line 144, may be configured to form the frac iron configuration 110, and comprise an arrangement of piping, valves, manifold(s) and device couplings that are intended to allow fracturing fluid to be transported to and introduced into the borehole 102 for the purpose of stimulation of the wellbore. Before starting the actual fracturing process, well stimulation system 100 may be configured and operated, according to the various embodiments as described herein, and/or according to variations thereof, to automatically pressure test the frack iron 110, which includes pumps 122, pump lines 142, manifold 130, and main line 144. Pressure testing may be performed to determine if leaks exist in the system 100, and/or to confirm that the system is adequately configured to withstand the maximum fluid pressures that the fracking iron 110 may be exposed to during a fracturing process.

In various embodiments of well stimulation system 100, each of the pump lines 142 is in fluid communication with a respective pump 122. As shown in FIG. 1, pump line 142A is coupled to pump 122A, pump line 142B is coupled to pump 122A, pump line 142C is coupled to pump 122C, and pump line 122N is coupled to pump 122N. Each of pumps 122 are configured to provide a controllable fluid pressure to the respective pump lines 142 by pumping a fluid, such as a fluid supplied by fluid source 140 coupled to each of the pumps, into the respective pump lines, and to generate a fluid pressure in the pump line. The fluid used may be in some embodiments the fracturing fluid that will be later utilized in fracturing processes utilizing the frac iron configuration 110, or in some embodiments the liquid portion of the fracturing fluid (without proppant). In an alternative embodiment, the fluid used to pressure these the frac iron configuration may be water, for example which may be used more safely in pressure testing the system prior to performing an acid fracturing operation utilizing the frac iron configuration 110.

For example, pump 122A may be coupled to fluid source 140 to receive a fluid, such as a fracturing liquid, and to pump the fluid into pump line 142A to generate a fluid pressure in pump line 142A. Similarly, pump 122B may be coupled to fluid source 140 to receive fluid, and to pump the fluid into pump line 142B to generate a fluid pressure in pump line 142B, pump 122C may be coupled to the fluid source 140 to receive fluid, and to pump the fluid into pump line 142N, and pump 122N may be coupled to fluid source 140 to receive fluid, and to pump the fluid into pump line 142N to generate a pressure in pump line 142N. Embodiments of well stimulation system 100 are not limited to having a particular number of pumps 122, and may include a single pump 122 or a plurality N of pumps 122, where N is two, three, four or more.

In various examples, each of the pump lines 142 provided in well stimulation system 100 may include a sensor 128 coupled to or otherwise linked to a respective pump line 128, and configured to provide an output indicative of a pressure level that is present within the respective pump line 142. As shown in FIG. 1, pump line 142A is coupled to pressure sensor 128A, pump line 142B is coupled to pressure sensor 128B, pump line 142C is coupled to pressure sensor 128C, and pump line 142N is coupled to pressure sensor 128N. Each of pressure sensors 128 may be configured to provide an output, such as an electrical output signal connected to a sensor input 138 of computing system 150, that is indicative of the pressure level that is present in the respective pump line 142 to which the pressure sensor 128 is coupled.

As illustrated in FIG. 1, pump lines 142A, 142B, and 142C through 142N are coupled to and are in fluid communication with manifold 130. In one example, manifold 130 includes an internal flow network 146 that may be used to provide fluid communication between pump lines 142 and main line 144. Manifold 130 may include one or more control valves, generally indicated in FIG. 1 as control valves 132 and 133. Control valve 132 may be operated to selectively and controllable couple one, more than one, or all of pump lines 142 to the input of control valve 133. Control valve 133 allows the manifold 130 to be selectively and controllably coupled and decoupled from main line 144.

In the example shown in FIG. 1, by controlling control valves 132 and 133, any combination and/or all of pump lines 142 may be controllable coupled and decoupled from main line 144. In addition to being operable to couple and decouple pump lines from the manifold output line, control valves 132 may include check valves that may be configured to prevent a backflow of fluid and/or the application of backpressure into a given pump line from one or more of the other pump lines. For example, a check valve may be included as part of control valve 132 that is coupled with pump line 142A and is configured to prevent any fluid pressure and fluid flow generated by fluid pressure in any of pump lines 142, and in main line 144 from being applied back through manifold 130 and into pump line 142A. Similarly, control value 132 may include individually controllable check valves for each pump line that prevent fluid backflow and fluid backpressure from being applied to a respective one of pump lines 142.

In addition to the check valve function that may be provided by control valve 132, each of pumps 122 may include a respective control/check valve 126. In the example shown in FIG. 1, a control/check valve 126 in each pump 122 may be arranged to selectively and controllable open and close off the respective pump line 142 coupled to the control/check valve so that any pressure present in the respective pump line 142 cannot bleed off pressure into the respective pump 122, for example when the respective pump 122 is not running or is running at a level that would not allow the pump to overcome the exiting pressure in the respective pump line 142. For example, control/check valve 126 of pump 122A is coupled to pump line 142A. In some example approaches, control check valve 126 of pump 122A may be configured to be selectively and controllably opened to allow fluid flow and fluid pressure generated by pump 122A to be coupled to pump line 142A, and to be selectively and controllable closed in order to seal off fluid flow and fluid pressure present in pump line 142A from backflowing and/or bleeding off back through pump 122A. Similarly control/check valve 126 of pump 122B may be configured to selectively and controllably couple and decouple pump line 142B to pump 122B, control/check valve 126 of pump 122C may be configured to selectively and controllably couple and decouple pump line 142C with pump 122C, and control/check valve 126 of pump 122N may be configured to selectively and controllably couple and decouple pump line 142N with pump 122N.

By controlling pumping operations of pumps 122, and by selectively controlling control/check valves 126, well stimulation system 100 may operate one or more of pumps 122 to provide fluid pressure to respective pump lines 142. By further controlling control valves 132 and 133 within manifold 130, well stimulation system 100 controls the coupling of fluid pressures and fluid flows from each of the pump lines 142 to main line 144 and between other pump lines. Further, by activating control valve 133 of manifold 130, coupling and decouple of the main line 144 from the pump lines 142 to isolate main line 144 from manifold 130 is possible. By doing so, and because isolation valve 106 and/or wellhead valve 110 may be configured to seal off the end of main line 144 at the top opening 105 of borehole 102, any fluid pressure present within main line 144 can be sealed at both ends of a portion of main line 144. Pressure sensor 134 may be coupled to main line 144 and configured to provide an output, such as an electronic signal, that is indicative of the fluid pressure present within that portion of main line 144.

Figure 4:
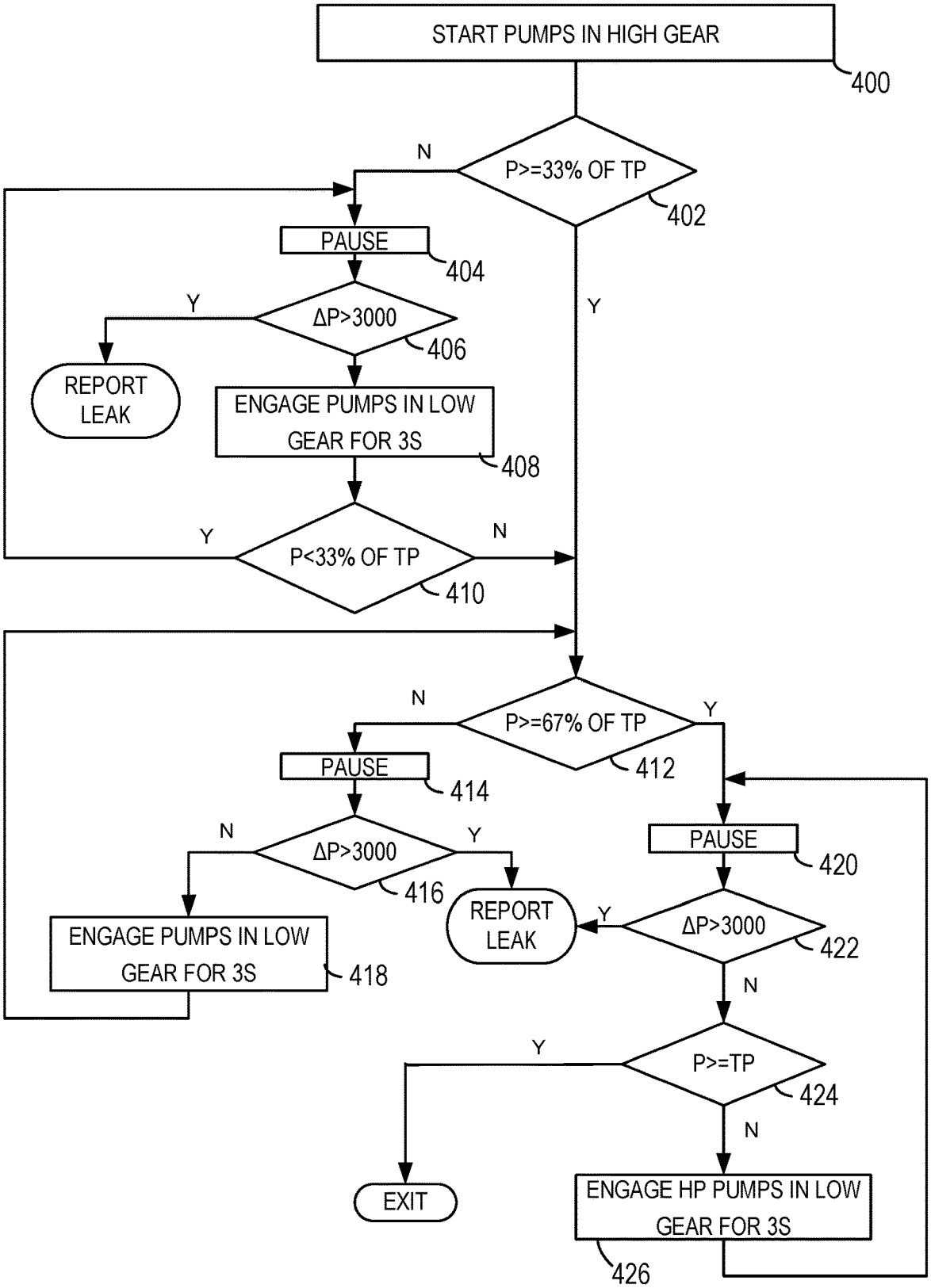
FIG. 4 is a flowchart illustrating another example method for pressure testing a frac iron configuration.

The automatic pressure testing procedures performed by well stimulation system 100 may be controlled at least in part by computer system 150. Computer system 150 may include one or more processors 152, which for simplicity are hereinafter referred to as processor 152. Processor 152 is not limited to any type of processor and may include multiple processors and/or different types of processors, such as a general processor and an image processor. Processor 152 may be coupled to memory, (such as memory 507 as shown in FIG. 4), that stores programs, algorithms, and parameter values that processor 152 operates on to perform the automatic pressure testing procedures performed by well stimulation system 100. Computer system 150 may include a display 154, which may be an interactive display such as a touch screen. Computer system 150 may further include one or more I/O devices 156, such as but not limited to a computer keyboard, a computer mouse, or other known devices that allow a system operator, such as a technician or engineer, to interact with computer system 150.

Computer system 150 may also include one or more sets of communication links 136, 138, 139, that allow computer system 150 to communication with other devices included within well stimulation system 100. For example, communication link 136 may be configured to communicatively couple computer system 150 to pumps 122, for example to communicate with the controller 124 of each pump 122. Communication link 136 may also provide computer system 150 with communication capabilities that allow computer system 150 to have control over the check valve 126 of each pump 122. Communication link 138 may be configured to communicatively couple computer system 150 to sensors 128 and 134, for example to receive electrical signal outputs corresponding to pressure sensor reading being made by sensors 128 and 134. Communication link 136 may also be configured to communicatively couple computer system 150 to devices located at manifold 130, such as control/check valves 132 and 133, for example to control the coupling and decoupling functions that may be provided by these control/check valves. Communication links 136, 138, 139 are not limited to any type of communication link, communication medium, or communication format, and may include any combination of communication links, mediums, and formats determined to be appropriate for use in the wellbore environment where the well stimulation system 100 may be utilized.

In one example approach, computer system 150 may be configured to control or provide control commands to controllers 124 of pumps 122 to control the operation of the pumps 122 and to control the operation of check valves 126. In addition, computer system 150 may be configured to control valves 132 and 133 of manifold 130. In one such example approach, computer system 150 uses the control of the pump controllers 124, check valves 126 and valves 132 and 133 to automatically perform one or more cycles of pressure testing on the frac iron configuration 110 of well stimulation system 100. Computer system 150 may also be configured to receive the output signals provided by sensors 128 and 134, and other sensors that may be part of well stimulation system 100. By controlling and monitoring these devices, computer system 150 may perform an automatic pressure testing procedure on a frac iron configuration 110, such as the frac iron configuration 110 as illustrated and described with respect to FIG. 1, using various predefined test parameters and test values to render a leak test status for the frac iron configuration 110. In one example approach, one or more of controllers, such as one or more of the N different controllers 124 shown in FIG. 1, perform some or all the functions ascribed herein to computer system 150.

In one example approach, pumps 122 are electric pumps and processor 152 of computer system 150 applies a progressive auto pressure test to pressurize and test pump lines 142, the flow paths through internal flow network 146, and main line 144. The progressive auto pressure test is an automated way of pressure testing which limits pressure overshoots and stress on the electric pumps. In one example approach, computer system 150 continuously increases the pressure level in frac iron configuration 110 while monitoring pressure sensors 128, 134 to determine whether leaks exist in the frac iron configuration 110. By controlling pumps 122 and, in conjunction, check valves 126, computer system 150 and processor 152 may control various operations of the pumps to pressurize the frac iron configuration 110 to increasingly higher levels of pressure. In some example approaches, initial pressurization of the frac iron configuration 110 includes operating all the electric pumps 122 to pressurize the frac iron configuration 110 to some initial pressure level, generally a pressure level that is much less, (e.g., 5 to 30 percent) of the target maximum pressure level (target pressure (TP)) of the frac iron configuration 110. In some such example approaches, processor 152 of computer system 150 also controls valves 132 and 133 of manifold 130 to allow fluid pressure generated within the pump lines 142 to be fluidly coupled to main line 144, thus pressuring main line 144 to the initial pressure level. One or more of the electric pumps 122 are then disabled while the remaining electric pumps 122 continue to operate to raise the pressure level to a second pressure level. In some example approaches, the process continues until the pressure level reaches a predefined level (such as 80% of target pressure), where a single electric pump 122 is used to take the frac iron configuration to the target pressure. Such an approach reduces wear on the pumps 122. In some example approaches, the order in which the electric pumps 122 are disabled during this process is determined based on a pressure schedule. In some such example approaches, computer system 150 determines the pressure schedule based on pump parameters, such as by determining the newest pump 122 and making the newest pump the final pump in the pressure schedule.

In one example approach, computer system 150 sets a local kickout pressure (local KOP) transducer for each pump 122 to a pressure level based on a predetermined pressure schedule and sets a global kickout pressure (global KOP) transducer for frac iron 110 to a pressure level greater than or equal to the target pressure. The predetermined pressure schedule is chosen to stagger local kickouts, the staggered local kickouts disabling the electric pumps 122 in a predefined order as the pressure in frac iron configuration 110 increases. Computer system 150 then enables the electric pumps 122. In one example approach, computer system 150 throttles up the final pump 122 by a first predetermined throttle number and the remaining electric pumps 122 by a second predetermined throttle number. In another example approach, computer system 150 throttles up all pumps 122 by the same predetermined throttle number. In one example approach, the final pump is the pump 122 with the shortest uptime hours.

In one such example approach, computer system 150 checks pressure at sensors 128 and 134 after one or more of predefined times and predefined pressure levels. In one example, computer system 150 pauses a predetermined time (e.g., an initial pause of one second) before making a first pressure check, determining if pressure at any of the sensors 128 and 134 has decreased by a predetermined pressure drop threshold (e.g., 3000 psi). If so, computer system 150 may output a request to a user via I/O device 156 to determine how pressure testing should proceed. In some examples, the pressure testing may be terminated, and the location and/or cause of the detected leak may be determined and repaired. In some examples, when the monitoring of the pressure drop over the pause indicates a leak is detected, computer system 150 configures one or more of control valves 132 and 133 and check valves 126 to individually isolate the pump lines 142 and the main line 144 from one another. Once the pump lines 142 and the main line 144 are individually isolated, pressure within each individual line 142, 144 may be monitored over a predetermined evaluation period, and the monitored pressures values at the expiration of the evaluation time may be evaluated to determine which individual device or devices are causing or contributing to the pressure leak or leaks within the frac iron configuration 110. In some examples, before isolating each individual pump line 142 and the main line 144 from each other, the system may repressurize the lines to the original initial pressure level that was used during the initial pressure test cycle. The steps of pressure testing the individual lines may be helpful in locating the specific device or devices where the pressure leak or leaks are occurring.

If, after the initial pause, the pressure drop is less than the predetermined pressure drop threshold (e.g., 3000 psi), computer system 150 continues the pressure test, with the pumps 122 in frac iron 110 that have not yet kicked out according to the pressure schedule continuing to pump. At a predefined time or pressure level thereafter, another pressure check is made. In one example approach, a check is made approximately every 0.5 seconds. At each pressure check, computer system 150 checks the pressure reading to determine whether there has been a pressure drop exceeding an acceptable pressure drop (e.g., 3000 psi) or a pressure greater than 99% of the target pressure. If the pressure drop in frac iron configuration 110 exceeds the acceptable pressure drop, leak detection proceeds as above. If the pressure is greater than 99% of target pressure and no leak was detected, the pressure test is completed. In one example approach, computer system 150 then messages a user with the results and equalizes the pressure level in frac iron 110 to the pressure level in borehole 102 before opening valve 106 and/or wellhead valve 110.

In another example approach, computer system 150 sets a global kickout pressure transducer for frac iron 110 to a pressure level greater than or equal to target pressure and retrieves a pressure schedule used to disable the electric pumps 122 in a predefined order as the pressure in frac iron configuration 110 increases. Computer system 150 then enables the electric pumps 122 and, in one example approach, throttles up the final pump by a first predetermined throttle number and the remaining electric pumps 122 by a second predetermined throttle number. A first pressure check is performed via sensors 128 and 134 at an initial pressure check time (e.g., one second after the pumps 122 are enabled) and then periodically after that (e.g., every 0.5 seconds). After each pressure check, computer system 150 determines if pressure at any of the sensors 128 and 134 has decreased by a predetermined pressure drop threshold (e.g., 3000 psi). If so, computer system 150 may output a request to a user via I/O device 156 to determine how pressure testing should proceed. In some examples, the pressure testing may be terminated, and the location and/or cause of the detected leak may be determined and repaired. In some examples, when the monitoring of the pressure drop over the pause indicates a leak is detected, one or more of control valves 132 and 133 and check valves 126 may be configured to individually isolate each of pump lines 142 and main line 144 from one another. Once the pump lines 142 and the main line 144 are individually isolated, pressure within each individual line 142, 144 may be monitored over a predetermined evaluation period, and the monitored pressures values at the expiration of the evaluation time period may be evaluated to determine which individual device or devices are causing or contributing to the pressure leak or leaks within the frac iron configuration 110. In some examples, before isolating each individual pump line 142 and the main line 144 from each other, the system may repressurize the lines to the original initial pressure level that was used during the initial pressure test cycle. The steps of pressure testing the individual lines may be helpful in locating the specific device or devices where the pressure leak or leaks are occurring.

If, after the pause, the pressure drop is less than the predetermined pressure drop threshold (e.g., 3000 psi), a check of the pressure and pressure schedule is made to determine the pumps to be taken off pause. Computer system 150 continues to monitor sensors 128 and 134, with pumps 122 disabled by computer system 150 according to the pressure schedule. At each pressure check, computer system 150 determines whether a pressure drop exceeding an acceptable pressure drop has occurred. If not, computer system 150 determines if system pressure is greater than 99% of target pressure. If the pressure drop in frac iron configuration 110 exceeds the acceptable pressure drop, leak detection proceeds as above. If the pressure is greater than 99% of target pressure and no leak was detected, the pressure test is completed. In one example approach, computer system 150 then messages a user with the results and equalizes the pressure level in frac iron 110 to the pressure level in borehole 102 before opening valve 106 and/or wellhead valve 110.

In another example approach, for pumps 122 that are not electric pumps, processor 152 of computer system 150 engages pumps 122 to pressurize pump lines 142, the flow paths through manifold 130, and main line 144, raising pressure in predetermined discrete amounts and monitoring pressure sensors 128, 134 to determine whether leaks exist in the frac iron configuration 110. By controlling pumps 122 and, in conjunction, check valves 126, computer system 150 and processor 152 may control various operations of the pumps to pressurize the frac iron configuration 110 to increasingly higher levels of pressure. In the following example pumps 122 are diesel pumps, but other pumps may be used as well.

In some example approaches, initial pressurization of the frac iron configuration 110 includes operating one or more diesel pumps 122 to pressurize the frac iron configuration 110 to some initial pressure level, generally a pressure level that is much less, (e.g., 5 to 35 percent) of the target pressure for the frac iron configuration 110. In some such example approaches, processor 152 of computer system 150 also controls valves 132 and 133 of manifold 130 to allow fluid pressure generated within the pump lines 142 to be fluidly coupled to main line 144, thus pressuring main line 144 to the initial pressure level.

In one example approach, once the initial pressure level is established, pumping may be halted, and pressure levels in each of the pump lines 142, along with the pressure level in main line 144, may be monitored, for example, for some predetermined time. In some embodiments, at the expiration of the predetermined time, the pressure levels within each of the pump lines 142 and within the main line 144 are evaluated to determine whether a leak exists within the frac iron configuration 110. In some example approaches, if a leak is detected based on the monitored pressure levels, computer system 150 may output a request to a user via I/O device 156 to determine how pressure testing should proceed. In some examples, the pressure testing may be terminated, and the location and/or cause of the detected leak may be determined and repaired. In some examples, when the monitoring of the pressures over the evaluation period indicates a leak is detected, one or more of control valves 132 and 133 and check valves 126 may be configured to individually isolate each of pump lines 142 and main line 144 from one another. Once the pump lines 142 and the main line 144 are individually isolated, pressure within each individual line may again be monitored over a predetermined evaluation period, and the monitored pressures values at the expiration of the evaluation time period may be evaluated to determine which individual device or devices are causing or contributing to the pressure leak or leaks within the frac iron configuration 110. In some examples, before isolating each individual pump line 142 and the main line 144 from each other, the system may repressurize the lines to the original initial pressure level that was used during the initial pressure test cycle. The steps of pressure testing the individual lines may be helpful in locating the specific device or devices where the pressure leak or leaks are occurring.

In some example approaches, if a pressure leak is determined to exist in a particular device of the frac iron configuration 110, that device may be isolated from the additional devices of the frac iron configuration 110, and the pressure testing of the remaining additional devices may continue with pressure testing at one or more elevated pressure levels. In instances where no leak was detected during the initial pressure testing cycle, the pressure testing may continue with one or more rounds of additional pressure testing cycles.

In one example approach, after the initial pressure testing cycle, the frac iron configuration 110 is further pressurized to a next predetermined pressure level using a second pump configuration. The next predetermined pressure level may be higher than the pressure level used to pressurize the frac iron configuration 110 in the initial pressure testing cycle. The next predetermined pressure level may be less than the target maximum pressure level, wherein the next pressure level may be for example in a range of twenty to fifty percent of the target maximum pressure level. The second pump configuration may be different or the same pump configuration as was used to pressurize the frac iron configuration in the initial pressure testing cycle. For example, the second pump configuration may utilize a number of pumps that is less than the number of pumps used during the initial pressurization cycle. In other examples, the second pump configuration may utilize a same number of pumps as was used in the initial pressure testing cycle, but while operating one or more of these pumps at one or more horsepower settings that is different from the horsepower settings used to configure the pumps in the initial pressure testing cycle. In some embodiments, a combination of the number of pumps and/or horsepower settings for the pumps being utilized may be configured as the second pump configuration that differs from the pump configuration used for the initial pressurization cycle of the pressure testing.

Once the frac iron configuration is pressurized to the next predetermined pressure level, a second evaluation period begins, and at the expiration of the second evaluation period, a determination is made by processor 152 with respect to any leaks being detected in the system based again on the pressure readings provided by the pressure sensors coupled throughout the frac iron configuration. At the expiration of the second evaluation period, a determination that a leak has been detected may result in a same set of options as was present with respect to the initial pressure testing cycle. For example, an output may be provided by computer system 150 indicating that a leak has been detected, and an input from an operation may be required to determine if the automatic pressure testing procedure is to be continued, or if the pressure testing procedure is to be terminated.

In some embodiments, this process of evaluating the pressure levels in the frac iron configuration 110, monitoring the pressure levels within the frac iron configuration over an evaluation time period, and evaluating the monitored pressure levels at the expiration of the evaluation time period to determine if a leak is present may be repeated any number of times until automatic pressure testing procedure has been terminated, for example in response to an input to terminate made by a system operator, or the pressure testing cycle utilizing the final and highest pressure level has been completed. If the pressure testing cycle utilizing the final pressure testing level has been completed and no leaks have been detected using this highest level of pressure testing, the frac iron configuration may be assigned an overall status of "PASS" with respect to leak testing. In some example approaches, a status of "PASS" may be required to then allow the frac iron configuration to be utilized for the purpose of transporting pressurized fracturing fluid to wellbore 102 as part of a fracking procedure. Otherwise, if one or more leaks were detected in the highest-level pressure testing, the frac iron configuration may be considered as having an overall status of "FAIL" with respect to leak testing. An overall status of "FAIL" may be an indication that the frac iron configuration is not be suitable for use in delivering fracturing fluid to wellbore 102 in a fracking process unless and until further repairs and or further pressuring testing is performed.

With respect to each of the pressure testing cycles described above, including the initial pressure testing cycle, and any addition pressure testing cycles including the final pressure testing cycle, a same or a different pump configuration may be utilized, between each of the completed pressure testing cycles and a next or subsequent pressure testing cycle. A different pump configuration may include any combination of a same or a different number of pumps being utilized and/or use of the same or a different number of pumps operating at different horsepower settings. Further, the evaluation time periods used to monitor the pressure levels during any given pressure testing cycle may be different time periods compared to the evaluation time period used on other pressure testing cycles. For example, an evaluation time period utilized during a given pressure testing cycle may be set to a shorter time period, a same time period, or a loner time period compared to the evaluation time period utilized by any of the previous pressure testing cycles and/or by subsequent pressure testing cycles.

In addition, the criteria used at the expiration of an evaluation time period to determine if a leak is present in the frac iron configuration is not limited to any particular criteria or technique and may include any detection criteria based on the pressure levels that were monitored over the evaluation time period for that respective pressure testing cycle. In various embodiments, a same set of evaluation criteria may be used for determining if leak(s) were detected during each pressure testing cycle performed as part of an automatic pressure testing procedure. In some embodiments, different sets or different types of decision criteria based on the monitored pressure level measurements may be applied to one or more of pressure testing cycles to determine if leak(s) were detected as a result of running that particular pressure testing cycle. Thus, well stimulation system 100 may be operated with a large degree of flexibility with respect to pump configurations, evaluation time periods, the number and variations in the pressure levels used, the total number of pressure testing cycle performed as part of an given automatic pressure testing procedure, and the criteria used to determine whether leak(s) were detected over the flexible number of pressure testing cycles that the system may perform in the process of establishing an overall pressure testing status for frac iron configuration.

A non-limiting example of a leak testing procedure that well stimulation system 100 may perform on the frac iron configuration 110 is described as follows. In one example approach, an initial purge of the frac iron configuration may be performed before initiating the automatic pressure testing procedure. For example, isolation value 106 may be opened to couple main line 144 to wellbore 102, and manifold 130 may be configured to couple each of pump lines 142 to main line 144. Each of pumps 122 may then be started and operated to provide a fluid flow to each of the respective pump lines 142. The fluid flow generated by pumps 122 may fill the respective pump lines 142 with a fluid, such as a fracturing fluid provided by fluid source 140, thus purging the pump lines of any gases or other fluids not intended to be included as part of the pressure testing procedure. The fluid flow may continue to purge the fluid paths within manifold 130 coupled to the pump lines, and extend into main line 144, purging these fluid passageways of any gases and other fluids that may be expelled out of the isolation value 106. Once purging has been completed, isolation valve 106 and/or wellhead valve 110 may be closed off to deadhead main line 144 relative to borehole 102, and all pumps 122 may be shut off, leaving the frac iron configuration scaled off between pumps 122 and isolation valve 106 and/or wellhead valve 110, and with fluid communication pathways being open between the pump lines 122 through the fluid network of manifold 130 to main line 144. At the completion of the purge process, the frac iron configuration may be filled with the same fluid that will be utilized to pressure test the frac iron, and with no fluid pressure or a very low level of fluid pressure present within the frac iron.

Well stimulation system 100 may initialize the automatic pressure testing procedure under the control of computer system 150 based, at least in part, on program instructions executed by processor 152. In one example approach, processor 152 receives or has access to various parameters associated with the automatic pressure testing procedure, including the number and operating parameters for controlling the pumps, the configuration of the flow passages through manifold 130, and values for any parameters to be controlled during the pressure testing procedure. The processor 152 also receives or has access to (for example in stored memory) a predetermined value for the maximum applied pressure (target pressure), the time value for the evaluation time periods, the maximum allowable bleed off pressure threshold values to be utilized to evaluate the pressure measurements during each of the pressure testing cycles, the number of pressure testing cycles to be performed, and the predetermined pressure level to be used at each pressure testing cycle. In one such example approach, a same predetermined evaluation time value is used for each of the pressure testing cycles, and a predetermined number of pressure testing cycles are scheduled. In various embodiments, a typical evaluation time is in the range of seconds, or in some examples up to or more than one minute.

In some example approaches, the maximum allowable bleed off is a pre-determined value that can be measured in terms of pressure drop over the evaluation time, pressure drop per minute measured over the evaluation time, the fractional change in pressure, et cetera, and are examples of criteria that may be used throughout and/or at the expiration of any evaluation time period to determine whether a leak in the frac iron was detected. The maximum allowable pressure drop over the evaluation time period will depend on the configuration of the frac iron. For example, an equally sized leak may cause a rapid pressure drop if the tubing volume is small, and a slower pressure drop if the tubing volume is large. The allowable pressure drop is a function of the compressibility of the fluid in the tubing, the stretch of the tubing, and the leakage past pump check valves. As a result, the acceptable maximum bleed off may be calculated from one or a combination of parameters including: the number of pump trucks, the pumping horsepower, the volume in the tubing, the fluid in the tubing, the compressibility of the fluid, the dimensions of the tubing, the applied pressure, and the stretch in the tubing.

In one example approach, all of pumps 122 are operated to pressurize the frac iron configuration to the initial evaluation pressure. Use of all pumps allows for the pressure to rise more quickly, thus saving time. Use of all pumps also allows for verifying the connection for all the pumps. The target initial evaluation pressure may be set at a value of approximately one-third the target pressure (approximately means +/−20 percent of each pressure level). Once the initial evaluation pressure is achieved within the frac iron configuration, the initial evaluation period is started and runs for the evaluation time predetermined for this initial pressure testing cycle. During the evaluation time, pressure sensors 128 and 134 monitor and collect data indicative of the pressure levels within the frac iron configuration at their respective positions throughout the frac iron configuration. At the expiration of the evaluation time, the monitored pressure data from the pressure sensors is evaluated based on the criteria that was chosen for evaluating whether a leak was detected during the initial pressure testing cycle.

If a determination is made that a leak was detected during the initial pressure testing cycle, computer system 150 may output an indication, such as causing a visual indication to be displayed on display 154, that a leak has been detected. In addition, computer system 150 may request an input from an operator, such as a technician or an engineer, as to how to proceed. Options may include terminating the automatic pressure testing procedure, or to continue the automatic pressure testing procedure including all or selected portions of the frac iron configuration.

In some example approaches, assuming that no or minimal leaks are detected during the initial pressure testing cycle, or that an input was received from an operator to continue the pressure testing procedure despite detection of a leak, a second pressure testing cycle is initiated. As part of the second pressure testing cycle, processor 152 configures a second pump configuration to operate to pressurize the frac iron configuration (or parts thereof) to a second evaluation pressure level that is higher than the pressure level used during the initial pressure testing cycle. In one embodiment, the second pumping configuration includes settings for one or more of pumps 122 using pumping horsepower settings that are reduced as the pressure continues to build. Reducing the amount of pumping horsepower may also be accomplished in part or in its entirety by engaging a fewer number of pumps 122. This technique of reducing pumping horsepower as the pressure level within the frac iron configuration increases may help to quickly build to the target pressure level for the second pressure testing cycle without risking over pressurizing the system. One of the features of this approach is to reduce or to eliminate the number of times that a pump is switched in-and-out of the neutral position. In a standard pressure test, the pumps may be switched through neutral as many as sixty-five times to slowly inch the pressure towards the target pressure level. These switching through neutral creates substantial wear on the transmission and on the pumps 122. By utilizing the incremental pressure levels applied to the pressure testing procedures as described herein, the number of switches required by the pumps may be minimized or at least reduced, thus reducing wear on the transmissions and on the pumps.

Once the second target pressure level is achieved within the frac iron configuration or portions thereof being tested, the second predetermined evaluation period is initiated, and extends over the time defined for the predetermined evaluation period. At the initiation of the second evaluation period, all of pumps 122, including any of the pumps that were utilized in the second pressure testing cycle to achieve the second evaluation pressure level, may be shut off so that no further pressure is applied to the frac iron configuration. In this configuration each of check valves 126 may prevent any backflow of pressure out of the frac iron configuration through the pumps, and therefore, any loss in fluid pressure within the frac iron configuration may be attributed to leaks in the frac iron configuration itself. Thus, the entirety of the frac iron configuration, including pump lines directly coupled to pumps not utilized in the second pump configuration to provide additional fluid pressure, may still be pressure tested as part of the second pressure testing cycle.

During the second evaluation period, pressure sensors coupled to the frac iron configuration monitor the pressure levels within various portions of the frac iron configuration. At the expiration of the second evaluation time, a determination is made, based on the monitored pressure levels, whether a leak in the frac iron configuration has been detected. In a manner the same as or similar to that described above with respect to the initial pressure testing cycle, any options may be available with respect to the automatic pressure testing procedure if a leak has been detected, including termination of the automatic pressure testing procedure or continuation of the automatic pressure testing procedure on some portion of the frac iron configuration or on the entirety of frac iron configuration.

Assuming that no leaks are detected as during the second pressure testing cycle, or that an input was received from an operator to continue the pressure testing procedure despite detection of a leak, a next and final pressure testing cycle is initiated by the processor. In this example, the target evaluation pressure level may be set to the target maximum pressure level. As part of the final pressure testing cycle, processor 152 configures a final pump configuration to operate to pressurize the frac iron configuration (or parts thereof) to the final evaluation pressure level, which is a higher level than the pressure level used during the second pressure testing cycle. In one embodiment, the final pumping configuration includes settings for one or more of pumps 122 using pumping horsepower settings that are reduced as the pressure continues to build, and/or that may utilize a lower pumping horsepower setting compared to the pumping horsepower setting the was utilized during the second pressure testing cycle.

Reducing the amount of pumping horsepower utilized in the final pumping configuration may also be accomplished in part or in its entirety by engaging a fewer number of pumps and/or by reducing the pumping horsepower setting for any of the pumps being utilized as part of the final pumping configuration. Again, this technique of using a smaller number of pumps and/or of reducing pumping horsepower of the pumps included in the final pump configuration as the pressure within the frac iron configuration increases may help to quickly build the test pressure to the targeted evaluation pressure level for the final pressure testing cycle without risking over pressurizing the system. This may be particularly critical as the pressure level within the frac iron configuration approaches the target pressure for the final pressure testing cycle, as the target level may be set at the target maximum pressure level. Thus, any pressurization above the target final pressure level may exceed the target maximum pressure level, creating a potentially damaging and/or unsafe condition. A pressure value for target pressure is typically on the order of 10,000 PSI to 20,000 PSI and may reflect the pressure levels that the frac iron configuration must be able to safely withstand when being utilized as part of a fracturing process being performed on borehole 102.

Once the final evaluation pressure level is achieved within the frac iron configuration or portions thereof being tested, the final evaluation time is initiated, and extends over the time value of the predetermined evaluation time. At the initiation of the final evaluation time, all of pumps 122, including any of the pumps 122 that were utilized in the final pressure testing cycle to achieve the final evaluation pressure level, may be shut off so that no further pressure is applied to the frac iron configuration. Again, in this configuration each of check valves 126 may prevent any backflow of pressure out of the frac iron configuration through the pumps 122, and therefore any loss in fluid pressure within the frac iron configuration can be attributed to leaks in the frac iron configuration itself. Again, as was the case during the second pressure testing cycle, the entirety of the frac iron configuration, including pump lines directly coupled to pumps not utilized in the final pump configuration to provide additional fluid pressure, may still be pressure tested as part of the final pressure testing cycle.

During the final evaluation time, pressure sensors coupled to the frac iron configuration monitor the pressure levels within various portions of the frac iron configuration. At the expiration of the final evaluation time, a determination is made, based on the monitored pressure levels, whether a leak in the frac iron configuration has been detected. If at the conclusion of the final evaluation time no leaks have been detected, processor 152 may provide an output, such as an output that can be visually display on display 154, that a status of "PASS" has been assigned to the frac iron configuration as a result of the automatic pressure testing procedure. In the alternative, if at the conclusion of the final evaluation time period one or more leaks have been detected, processor 152 may provide an output, such as an output that can be visually displayed on display 154 that a status of "FAIL" has been assigned to the frac iron configuration as a result of the automatic pressure testing procedure. In some example approaches, assigning a status of "FAIL" indicates that the automatic pressure testing procedure detected one or more leaks during the final pressure testing cycle. In other example approaches, assigning a status of "FAIL" indicates that the automatic pressure testing procedure detected one or more leaks during any of the pressure testing cycles performed as part of the automatic pressure testing procedure. This option may be useful for example in situations wherein one or more leaks were detected during a pressure testing cycle that was performed at pressure levels less than the final evaluation pressure level, but because of an input provided by a system operator, the automatic pressure testing procedure was allowed to continue. In these instances, additional information related to which pressure testing cycle and/or which portions of the frac iron configuration were determined to have leaks may be generated by processor 152 and output, for example as visual displays provided to display 154, for further evaluation by a system operator, technician, or engineer.

The above-described example of an automatic pressure testing procedure is provided as a non-limiting example, and many variations to this example are possible and contemplated for use in the automatic pressure testing procedure as described herein, and any equivalents thereof. For example, the number of pressure testing cycles performed in order to reach the final pressure testing level is not limited to any particular number of cycles and may include a number of cycles that is deemed appropriate to confirm the integrity of the frac iron configuration in view the type of equipment and devices included in and coupled to the frac iron configuration. In some embodiments, between each step in the pressure testing procedure, a human operator may have the option of evaluating the pressure bleed off. The pressure bleed off is a measure for how the pressure drops with respect to evaluation time. This measurement is functionally equivalent to a pressure retention measurement which measures how the pressure is maintained with respect to time. In some embodiments, the pumps are stopped during each of the evaluation times. The drop in pressure is noted over the evaluation time. If the pressure drops more than the maximum bleed-off, then a leak is declared, the pressure is decreased, and the leak is isolated. However, an operator may have the option to override any such determination made by processor 152 and may provide an input to the processor 152 as to how the automatic pressure testing procedure is to proceed. A determination as to whether a leak has been detected at the conclusion of any given pressure testing cycle is not limited by any particular criteria or to any particular evaluation technique. In some embodiments, the bleed-off pressure within one or within multiple portions of the frac iron configurations is/are monitored as the slope of a pressure curve, dP/dt. The change in the slope helps to identify the type of behavior that is causing the pressure bleed. For example, a leak in a connection is characterized by a quadratic pressure loss that persists over time. Compressibility or stretch in the tubing is a more rapid change that quickly equalizes. Air in the lines can cause rapid pressure changes but will equalize more rapidly than a tubing leak. The size of the leak can be estimated from the pressure change as well as other parameters of the pump operation. Knowing the size of the leak can help guide identifying the location of the leak. If pressure bleed-off attributed to tubing compressibility exceeds an expected value, processor 152 and provide an output signal to alert an operator. In some embodiments, the output signal can include an indication that a wall thickness of the tubing within some portion of the frac iron configuration has been diminished either due to erosion or to corrosion. If the wall thickness of the tubing is reduced, then more stretch will be encountered. A reduced wall thickness may also be a sign of reduced pipe life. Any of these issues may be detected by the automatic pressure testing procedures and brought to the attention of an operator for further review and possible repair.

In various embodiments, pressure signals provided by the pressure sensor or pressure sensors monitoring pressure level(s) throughout the frac iron configuration may be further processed for better quality and evaluation purposes. For example, in various embodiments the pressure data generated by the pressure sensor signal is frequency filtered. The pressure data may be low-pass filtered to see pressure trends, and/or high-pass filtered to see resonance behavior that is inherent to different sections of the frac iron. A combined band-pass filter can also be applied to the pressure data generated from the signals provided by the pressure sensors.

As described above, pressure sensors may be located at various locations throughout the frac iron configuration to allow for pressure monitoring at multiple locations. Due to the friction in the fluid flow pathway of the frac iron configuration, the pressure drop may be different at different locations. Thus, if there is a leak close to, for example, pressure sensor 128A, that sensor may show a loss in pressure level occurring more quickly than the pressure levels being monitored by sensors at other locations. More distant locations with greater fluid friction in between, such pressure sensor 134 may, for instance, have the slowest pressure decay. Thus, by comparing the relative rates of pressure losses at different pressure sensors, a determination may be made with respect to the approximate location of the pressure leak. In some example approaches, well stimulation system 100 includes additional pressure sensors (not shown in FIG. 1) that are located between the check valves 126 and their respective pumps 122, which are configured for monitoring pressure levels behind the check values 126 relative to the pump lines. Monitoring of these pressure levels using these additional pressure sensors can be useful in identifying leaking check valves.

Figure 2:
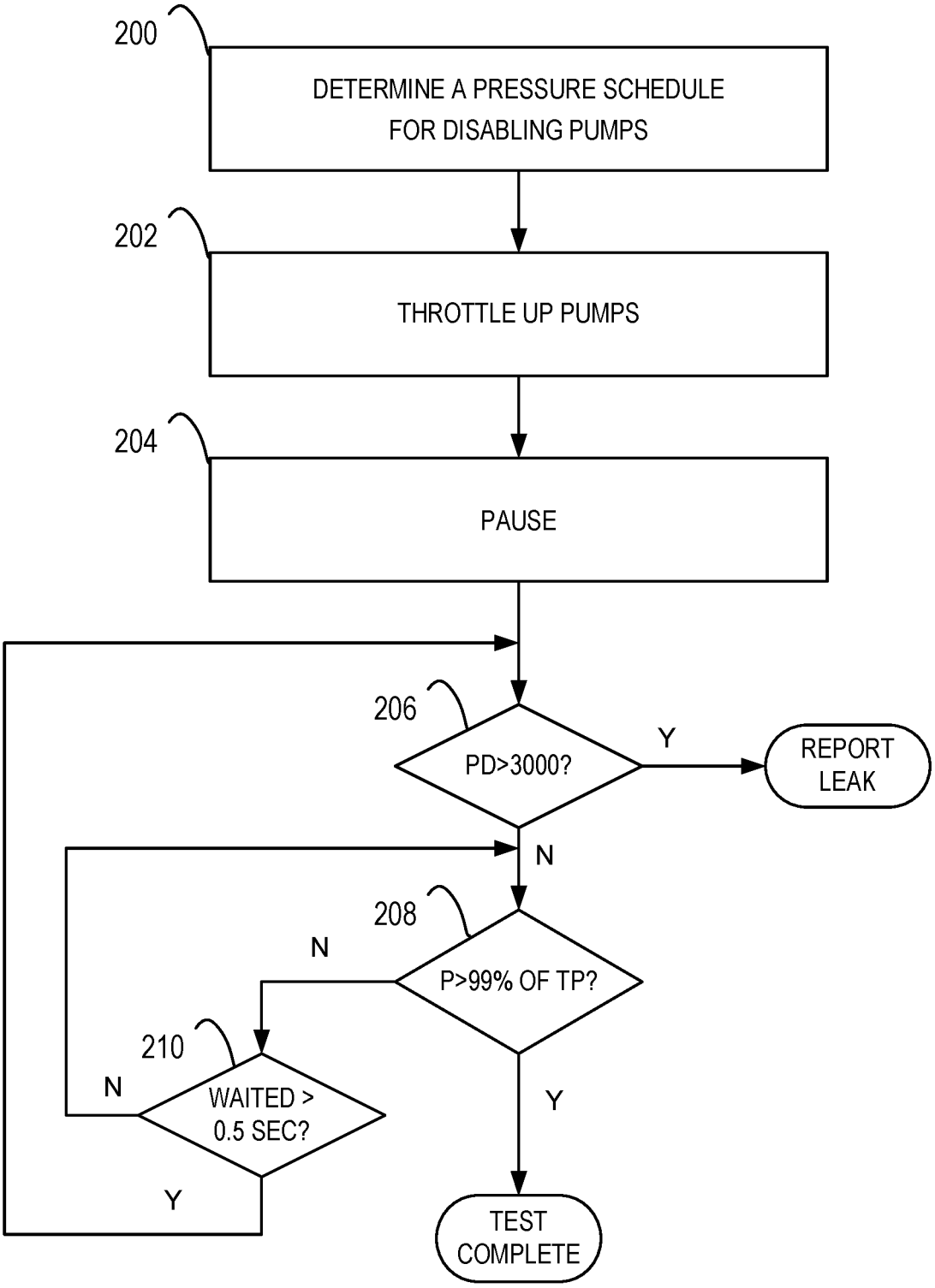
FIG. 2 is a flowchart illustrating an example method for pressure testing a frac iron configuration using electrically powered pumps.

FIG. 2 illustrates a flowchart of an example method for pressure testing a frac iron configuration using electrically powered pumps. In various example approaches, the example method may be performed by a computer system, such as but not limited to computer system 150 as illustrated and described with respect to FIG. 1. In various embodiments, one or more processors, such as but not limited to processor 152 of computer system 150 (FIG. 1), may perform computing operations that control and/or perform some, all, or any combination of the processes described with respect to the example method, and any equivalents thereof.

In the example approach of FIG. 2, pumps 122 are electric pumps, and computer system 150 applies a progressive auto pressure test to pressurize and test frac iron configuration 110. As noted above, the progressive auto pressure test is an automated way of pressure testing which limits pressure overshoots and stress on the electric pumps by turning the pumps 122 on and keeping the pumps on until disabled in the order specified in a pressure schedule. In one such example approach, groups of pumps 122 are turned off at predetermined pressure levels, with the schedule determining the pumps to disable at each pressure level.

In the example method of FIG. 2, a pressure schedule is determined (block 200). In one such example approach, determining the pressure schedule includes assigning to each pump 122 a pressure level at which the pump is disabled. In one such example approach, computer system 150 disables pumps 122 in the order and at the pressure defined in the pressure schedule. In another example approach, each pump 122 includes a kickout transducer and computer system 150 sets the kickout pressure for each transducer as defined by the pressure schedule. Computer system 150 then continuously increases the pressure level in frac iron configuration 110 while monitoring pressure sensors 128, 134 to determine whether leaks exist in the frac iron configuration 110. By controlling pumps 122 and, in conjunction, check valves 126, computer system 150 and processor 152 may control various operations of the pumps to pressurize the frac iron configuration 110 to increasingly higher levels of pressure.

In one example approach, computer system 150 turns on the pumps 122 (block 202). Computer system 150 then waits a predetermined time (e.g., 1 s) (block 204) before testing for pressure drop (206). If the pressure has dropped more than a predefined amount (e.g., 3000 psi), a leak has been detected and computer system 150 reports the leak. If, however, the pressure has dropped less than the predefined amount, a check is made to determine if the frac iron pressure is greater than 99% of target pressure (block 208). If the frac iron pressure is less than or equal to 99% of target pressure, computer system 150 waits a predetermined time t (e.g., 0.5 s) (block 210) before moving to block 206.

In some example approaches, initial pressurization of the frac iron configuration 110 includes using all the electric pumps 122 to pressurize the frac iron configuration 110 to some initial pressure level, generally a pressure level that is much less, (e.g., 5 to 35 percent) of the target pressure for the frac iron configuration 110. One or more of the electric pumps 122 are then disabled according to the pressure schedule, while the remaining electric pumps 122 continue to operate to raise the pressure level to a second pressure level. In some example approaches, the process continues until the pressure level reaches a predefined level (such as 80% of the target pressure), where a single electric pump 122 is used to take the frac iron configuration to the target pressure. Such an approach reduces wear on the pumps 122. In some example approaches, computer system 150 determines the pressure schedule at block 200 based on pump parameters, such as by determining the newest pump 122 and making the newest pump the final pump in the pressure schedule.

In one example approach, computer system 150 begins the pressure test by enabling the pumps 122 to run continuously, automatically performing leak tests for the frac iron configuration at different pressure levels as the pressure increases. In addition, as the pressure increases, computer system 150 turns off pumps at different pressure levels as detailed in a pressure schedule (such as detailed in FIGS. 3A and 3B). As noted above, when a leak is detected, computer system 150 determines if the pressure drop exceeds a threshold pressure drop before reporting the leak. In one example approach, detecting a leak includes isolating the leak. In one example approach, isolating the leak includes closing valves in the frac iron configuration to isolate sections of the frac iron configuration and trying to detect a leak in one or more of the isolated sections. In another example approach, isolating the leak includes repressurizing the frac iron configuration to reduce the pressure drop, closing valves in the frac iron configuration to isolate sections of the frac iron configuration and trying to detect a leak in one or more of the isolated sections.

In one example approach, pressure in frac iron 110 is gradually increased up to test pressure while monitoring for pump leak off and overall system leak off. In this configuration a total number of 10 pumps each capable of 2000 horsepower was used. All pumps were used for some duration of pressure testing and individual pumps were used in other duration determined by control system at each point. These variations illustrate possible embodiments of the systems, apparatus, methods and techniques that may be utilized by the automatic pressure testing procedures described throughout this disclosure, and any equivalents thereof. In one example approach, reporting a leak includes sending a warning message before continuing the leak test. In another example approach, reporting a leak includes sending an error message and terminating the leak test.

In some example approaches, the progressive pressure test of FIG. 2 includes a series of tests that are performed before the pressure test. In one such example approach, the progressive automatic pressure test begins by setting all pumps to neutral and setting each pump 122 in pressure test mode. A check is made to determine if any pumps are at a low pressure (e.g., <100 psi). If so, set all local KOP to 500 psi, enable all pumps and throttle the low-pressure pumps up 2×. Pause for 2 s, then neutral all pumps 122 and check if any of the low-pressure pumps are still <100 psi. Loop on the routine 3 times and then test global KOP (kickout pressure of the system power level transducer). In another example approach, system 100 has an "Equalize Pressure" option. If this option is on, the user may enter a lower Pmax of 1,000-7,500 psi, and the test global KOP and test local KOP steps are skipped.

When testing global KOP, computer system 150 may determine if global KOP<100 psi. If so, exit. Otherwise, set global KOP to 25 psi, turn on global KOP and enable and throttle up ×2 all pumps. Pause 3 seconds and, if any pumps are still engaged, neutral and exit. Proceed to test local KOP.

When testing local KOP (kickout pressure of each of the pump transducers), computer system 150 sets global KOP to target pressure, turns on global KOP and, if a value (ePRV) of global KOP<target pressure, sets ePRV to target pressure+100 psi. If group pressure<100 psi, exit. If a delta between a lowest and a highest-pressure delta is >1500 psi, exit.

Set local KOP to lowest pump pressure (approximately 50 psi), enable and throttle all pumps up, and pause 3 seconds. If any pumps are still engaged, neutral and exit. If pressure increased by greater than 100 psi, exit. Otherwise, run the progressive auto pressure test of FIG. 2. On exiting the progressive auto pressure test of FIG. 2, in some example approaches computer system 150 neutrals all pumps, turns off pressure test mode and, if ePRV was adjusted, sends a user message indicating that ePRV had changed during the test.

In one example approach, the method of FIG. 2 may be used to pressurize frac iron configuration 110 to a desired pressure level without the pressure test. In one such example approach, the method applies a pressure schedule that disables one or more electric pumps at each of two or more predefined pressure levels. In one such example approach, the method skips checking for pressure drop (block 206) and, in some example approaches, reduces the pause at block 210 to detect pressure more frequently.

In some example approaches, a pressure schedule has first, second and third sets of the electric pumps, wherein the second set is a subset of the first set and the third set is a subset of the second set. Computer system 150 enables the first set of electric pumps to pump fluid continuously from the fluid supply to the frac iron configuration until the fluid in the manifold has reached a first pressure level. Computer system 150 automatically disables the electric pumps from the first set of pumps that are not in the second set of electric pumps after reaching the first pressure level, while allowing the second set of pumps to continue to pump fluid from the fluid supply to the frac iron configuration until the fluid in the manifold has reached a second pressure level. Computer system 150 automatically disables the electric pumps from the second set of pumps that are not in the third set of electric pumps after reaching the second pressure level, while allowing the third set of pumps to continue to pump fluid from the fluid supply to the frac iron configuration until the fluid in the manifold has reached a third pressure level.

FIGS. 3A and 3B illustrate example pressure schedules for the well stimulation system of FIG. 1. In the example approach of FIG. 3A, pressure schedule 300 includes a first column 302 and a second column 304. First column 302 includes a series of pressure levels expressed as a percentage of a target pressure for the frac iron configuration 110. Second column 304 lists the number of active electric pumps to be disabled at each pressure level, where each value is associated with one of the power levels (expressed as percentages in column 302). In the example approach of FIG. 3A, all N pumps of FIG. 1 are used to raise the pressure in frac iron configuration 110 to 50% of target pressure. Approximately 0.6N+2 pumps 122 are used to raise the pressure in frac iron configuration 110 to 60% of target pressure. Approximately 0.3+2 pumps 122 are used to raise the pressure in frac iron configuration 110 to 70% of target pressure. Two pumps 122 are used to raise the pressure in frac iron configuration 110 from 70% to 80% of target pressure and one pump 122 is used to raise the pressure to within 99% of target pressure.

In the example approach of FIG. 3B, pressure schedule 310 includes a first column 312, a second column 314 and a third column 316. First column 302 includes a series of pressure levels expressed as a global pressure level (in psi) for the frac iron configuration 110 when target pressure is 10,000 psi. Second column 304 includes lists the number of pumps that are disabled at each power level. In the example shown in FIG. 3B, there are 20 pumps. The twenty pumps run continuously up to 5000 psi, at which point 6 pumps are disabled. Third column 316 lists the number of pumps in use up to the given pressure level (column 3 is redundant but is provided for illustration). In the example approach of FIG. 3B, all N pumps (where, e.g., N=20) of FIG. 1 are used to take the pressure in frac iron configuration 110 to 50% of target pressure. Six pumps of the twenty pumps are then disabled, leaving fourteen pumps 122 to be used to take the pressure in frac iron configuration 110 to 60% of target pressure. Six pumps of the fourteen pumps are disabled at 6000 psi, leaving eight pumps 122 to be used take the pressure in frac iron configuration 110 to 70% of target pressure. Six pumps of the eight remaining pumps are disabled at 7000 psi (70% of the test pressure), leaving two pumps 122 to be used take the pressure in frac iron configuration 110 from 70% to 80% of the target pressure. One pump 122 is disabled at 9000 psi, leaving one pump 122 to be used to take the pressure to within 99% of the target pressure.

As noted above in the discussion FIGS. 1 and 2, there are different ways to selectively disable electric pumps 122 at predefined pressure levels. For instance, transducers associated with each pump may be used and computer system 150 programmed to set the KOP of each pump as needed to stagger per the pressure schedule. In another example approach, computer system 150 stores the pressure schedule and disables the appropriate pumps 122 as needed to meet the pressure schedule. In another example approach, a pressure level is assigned to each pump and each controller 124 is programmed to disable its respective pump 122 when global pressure reaches a desired pressure level.

FIG. 4 illustrates a flowchart of an example method for pressure testing a frac iron configuration using diesel powered pumps. In various example approaches, the example method may be performed by a computer system, such as but not limited to computer system 150 as illustrated and described with respect to FIG. 1. In various embodiments, one or more processors, such as but not limited to processor 152 of computer system 150 (FIG. 1), may perform computing operations that control and/or perform some, all, or any combination of the processes described with respect to the example method, and any equivalents thereof.

In the example approach of FIG. 4, pumps 122 are diesel pumps, and computer system 150 applies a pressure test that pressurizes frac iron configuration 110 to predefined levels before testing for pressure drop at each pressure level. Diesel pumps differ from electric pumps in that diesel pumps can be turned on and off as part of the pressure test without placing undue stress on pumps 122. In one example approach, the pumps used to pressurize the frac iron to each pressurization level are detailed in a pressure schedule such as shown in FIG. 3. In some such example approaches, the pressure schedule also includes a target pressure for the frac iron configuration pressure test. The pressure schedule may also indicate the number of discrete pressurization levels. In the example shown in FIG. 4, there are three pressurization levels.

In the example approach of FIG. 4, the test begins by placing the pumps 122 in high gear (block 400). A check is made to determine if the pressurization level is above 33% of the target pressure (block 402). If not, the pumps are paused (block 404) and one or more checks are made during the pause to determine if the system pressure has dropped more than a threshold pressure drop (block 406). In the example shown in FIG. 4, the threshold pressure drop is 3000 psi. If the pressure drop at block 406 is greater than the pressure drop threshold, a leak is reported. In one example approach, when a leak is detected, the test is terminated. In another example approach, when a leak is detected, the leak is noted and the computer system 150 attempts to isolate sections of the frac iron (using, for instance, valves as shown in FIG. 1). If the leak is traced to a section of the frac iron, the test is terminated, and the leak may be repaired.

If, at block 406, the system pressure has not dropped more than the threshold pressure drop, computer system 150 engages the enabled pumps for a predetermined amount of time (here, 3 second) (block 408) before checking if the frac iron has moved into the next pressurization level (block 410). If not, computer system 150 pauses at block 404 before testing again for pressure drop. If, however, the frac iron has moved into the next pressurization level, a check is made to determine if the frac iron is still within the next pressurization level (block 412). If so, computer system 110 pauses (block 414) before testing again for pressure drop.

At block 416, a check is made to determine if the pressure has dropped more than a threshold pressure drop. If, however, the system pressure has not dropped more than the threshold pressure drop, computer system 150 engages the enabled pumps for a predetermined amount of time (here, 3 second) (block 418) before checking if the frac iron has moved into the next pressurization level (block 412). If not, computer system 150 pauses at block 414 before testing again for pressure drop. If, however, the frac iron has moved into the next pressurization level, computer system 150 pauses at block 420 before testing again for pressure drop (block 422).

If the system pressure has dropped more than the threshold pressure drop, computer system 150, a leak is reported. If the system pressure has not dropped more than the threshold pressure drop, computer system 150 checks to determine if the system pressure has reached the target pressure. If so, computer system 150 exits the test.

If the system pressure has not reached the target pressure at block 424, computer system 150 engages the enabled pumps for a predetermined amount of time (here, 3 second) (block 426) before pausing at block 420 before testing again for pressure drop (block 422).

In some example approaches, the pump configuration changes at each pressurization level. For instance, in the example shown in FIG. 4, only high-pressure pumps are engaged at block 426. In one such example approach, the pumps included in and configured for each pressurization level are defined in a pressure schedule. Based on the outputs provided by the pressure sensors, the processor 152 controlling the next pump configuration may stop the pumps included in the next pump configuration from further pressurizing the frac iron configuration once the next predetermined evaluation pressure has been reached within the frac iron configuration. In some embodiments, the pumps included in the next pump configuration may be stopped, while also preventing any pressure from the fluid within the frac iron configuration from backflowing or being otherwise received through the pump itself.

In some example approaches, the automatic pressure test of FIG. 4 includes a series of tests that are performed before the pressure test. In one such example approach, the automatic pressure test begins by setting all pumps to neutral and setting each pump 122 in pressure test mode. A check is made to determine if any pumps are at a low pressure (e.g., <100 psi). If so, set all local KOP to 500 psi, enable all pumps and throttle the low-pressure pumps up. Pause for 2 s, then neutral all pumps 122 and check if any of the low-pressure pumps are still <100 psi. Loop on the routine one or more times and then test global KOP.

When testing global KOP, computer system 150 sets pumps 122 to high gear, pauses for 1 second and then throttles the engines down. If global KOP<100 psi, exit. Otherwise, set global KOP to 25 psi, set global KOP to 25 psi and turn on global KOP. Neutral all pumps proceed to test local KOP. When testing local KOP, computer system 150 sets global KOP to target pressure, turns on global KOP and sets the system to pressure test mode. Pumps are set to highest gear and, if a local KOP fails, exit.

In one example approach, the method of FIG. 4 may be used to pressurize frac iron configuration 110 to a desired pressure level without the pressure test. In one such example approach, the method applies a pressure schedule such as shown in FIG. 4 that disables one or more diesel pumps at each of two or more predefined pressure levels. In one such example approach, the method skips checking for pressure drop at each of blocks 406, 416 and 422.

In some example approaches, a pressure schedule has a plurality of pressure levels, including a first, second and third pressure level, wherein each pressure level is associated with a predefined pump configuration. Computer system 150 automatically performs a pressurizing cycles on a frac iron configuration, with each of the pressurizing cycles including pressurizing the frac iron configuration with a fluid until the fluid in the manifold has reached one of the pressure levels in the pressure schedule and when the fluid in the manifold has reached one of the pressure levels in the pressure schedule, switching to the pumps to the predefined pump configuration associated with the next higher pressure level.

Figure 5:
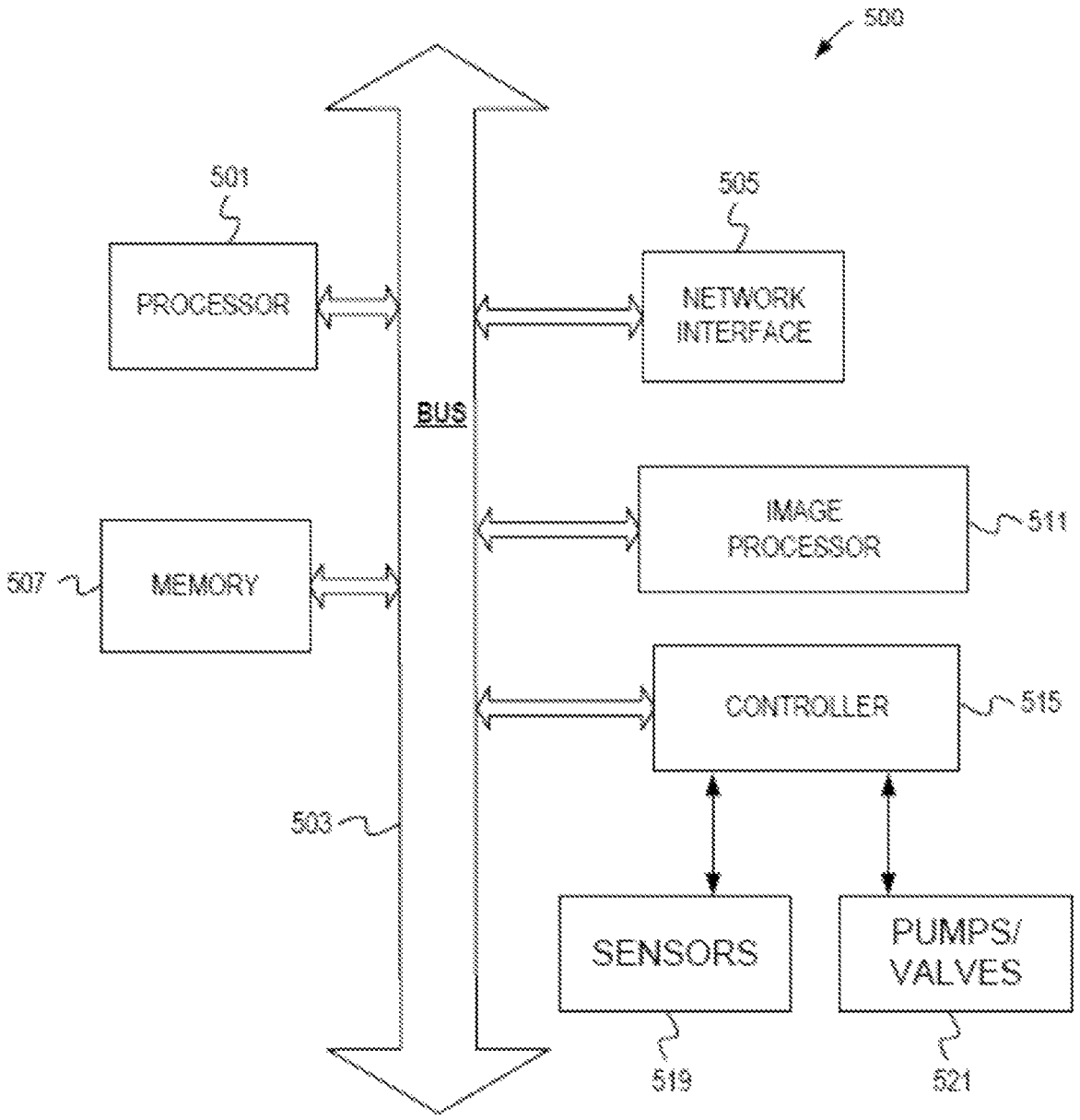
FIG. 5 illustrates a block diagram of an example computing system that may be used as the computer system of FIG. 1.

FIG. 5 illustrates a block diagram of an example computing system that may be used as the computer system 150 of FIG. 1. Computer system 500 may be employed to practice the concepts, methods, and techniques disclosed herein, and variations thereof. In one example approach, computer system 500 includes a plurality of components in electrical communication with each other, in some examples using a bus 503. The computing system 500 may include any suitable computer, controller, or data processing apparatus capable of being programmed to carry out the method and apparatus as further described herein.

In one example approach, computing system 500 may be a general-purpose computer, and may include a processor 501 (possibly including multiple processors, multiple cores, multiple nodes, and/or implementing multi-threading, etc.). In one such example approach, computer system 500 includes a memory 507. The memory 507 may be system memory (e.g., one or more of cache, SRAM, or DRAM) or any one or more of the possible realizations of machine-readable media. Computer system 500 also includes bus 503 (e.g., PCI, ISA, PCI-Express, etc.) and a network interface 505 (e.g., ethernet or Fiber Channel).

The computer may also include an image processor 511 and a controller 515. The controller 515 can control the different operations that can occur in the response inputs from sensors 519 and/or calculations based on inputs from sensors 519 (such as sensors 128 and 134 of the well stimulation system of FIG. 1) using any of the techniques described herein, and any equivalents thereof, to provide outputs to control pumps 122, valves 126 and valves 133. In some example approaches, controller 515 may communicate instructions to the appropriate equipment, devices, etc. to alter control number and/or the horsepower setting use by the pumps (such as pumps 122 in FIG. 1) and/or to set and control valves (such as valves 126 and 134, as illustrated in FIG. 1) that may be utilized in an automatic pressure testing procedure. Any one of the previously described functions may be partially (or entirely) implemented in hardware and/or on the processor 501. For example, the functions may be implemented with an application specific integrated circuit, in logic implemented in the processor 501, in a co-processor on a peripheral device or card, etc. Further, realizations may include fewer or additional components not illustrated in FIG. 5 (e.g., video cards, audio cards, additional network interfaces, peripheral devices, etc.). As illustrated in FIG. 5, the processor 501 and the network interface 505 are coupled to the bus 503. Although illustrated as also being coupled to the bus 503, the memory 507 may be coupled to the processor 501 only, to both processor 501 and bus 503 or to processor 501, image processor 511 and memory 507. Controller 515 may be coupled to sensors 519 and to pumps/valves 521 using any type of wired or wireless connection(s), and may receive data, such as measurement data, obtained by sensors 519 or provided by the pumps/valves 521. Sensors 519 may include any of the sensors associated with a wellbore environment, including but not limited to the pressure sensors configured to output signals indicative of pressure level within a frac iron configuration. Measurement data may include any of the data associated with an automatic pressure testing procedure. Controller 515 may include circuitry, such as analog-to-digital (A/D) converters and buffers that allow controller 515 to receive electrical signals directly from one or more of sensors 519.

Processor 501 may be configured to execute instructions that provide control over the automatic pressure testing procedures described in this disclosure, and over any equivalents thereof. For example, processor 501 may control operations of one or more pumps being utilized to pressurize a frac iron configuration as part of an automatic pressure testing procedure. Control of pumps may include determining a set of predefined pump configurations, wherein a particular one of the predefined pump configurations are assigned to be used during each of a plurality of pressure testing cycles, and providing output signal, for example to controller(s) located at the pumps, to configure and control the operations of the pumps at each pressure testing cycle according to the predefined pump configuration that is to be applied to that particular pressure testing cycle. Processor 501 may also be configured to receive output signals generated by the sensor 519, to process the signals to generate pressure level data, and to utilize that pressure level data to determine if a leak or leaks have been detected during the pressure testing procedure. Processor 501 may also be configured to support any interaction between a system user and computer system 500, including generating for display output information related to the results obtained from running an automatic pressure testing procedure on a frac iron configuration, and receive and process inputs provide by a system user to computer system 500, for example regarding how to proceed with the automatic pressure testing procedure when leaks are detected by the procedure.

With respect to computing system 500, basic features here may easily be substituted for improved hardware or firmware arrangements as they are developed. In some examples, memory 507 includes non-volatile memory and can be a hard disk or other types of computer readable media which can store data that are accessible by a computer, such as magnetic cassettes, flash memory cards, solid state memory devices, digital versatile disks (DVDs), cartridges, RAM, ROM, a cable containing a bit stream, and hybrids thereof.

It will be understood that one or more blocks of the flowchart illustrations and/or block diagrams, and combinations of blocks in the flowchart illustrations and/or block diagrams, may be implemented by program code. The program code may be provided to a processor of a general purpose computer, special purpose computer, or other programmable machine or apparatus. As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine. While depicted as a computing system 400 or as a general-purpose computer, some embodiments can be any type of device or apparatus to perform operations described herein.

EXAMPLE EMBODIMENTS

Embodiment #1: A method for controlling a plurality of electric pumps configured to pump fluid from a fluid supply to a frac iron configuration, the frac iron configuration including a manifold connected to the electric pumps, the method comprising defining a pressure schedule having first, second and third sets of the electric pumps, wherein the second set is a subset of the first set and the third set is a subset of the second set; enabling the first set of electric pumps to pump fluid continuously from the fluid supply to the frac iron configuration until the fluid in the manifold has reached a first pressure level; automatically disabling the electric pumps from the first set of pumps that are not in the second set of electric pumps after reaching the first pressure level, while allowing the second set of pumps to continue to pump fluid from the fluid supply to the frac iron configuration until the fluid in the manifold has reached a second pressure level; and automatically disabling the electric pumps from the second set of pumps that are not in the third set of electric pumps after reaching the second pressure level, while allowing the third set of pumps to continue to pump fluid from the fluid supply to the frac iron configuration until the fluid in the manifold has reached a third pressure level.

Embodiment #2: The method of Embodiment #1, wherein the third set of electric pumps includes only one electric pump.

Embodiment #3: The method of Embodiment #1, wherein disabling the electric pumps from the second set of pumps that are not in the third set of electric pumps includes testing for a leak in the frac iron configuration and, if a leak is detected, reporting the leak.

Embodiment #4: The method of Embodiment #3, wherein reporting a leak includes isolating the leak, wherein isolating the leak includes repressurizing the frac iron configuration to reduce a pressure drop, closing valves in the frac iron configuration to isolate sections of the frac iron configuration and detecting a leak in one or more of the isolated sections.

Embodiment #5: The method of Embodiment #4, wherein reporting a leak includes isolating the leak.

Embodiment #6: The method of Embodiment #5, wherein isolating the leak includes closing one or more valves to isolate sections of the frac iron configuration; and detecting a leak in one or more of the isolated sections.

Embodiment #7: The method of Embodiment #3, wherein reporting a leak includes sending a message before continuing to the third pressure level.

Embodiment #8: The method of Embodiment #1, wherein the pressure schedule details the first and second pressure levels and associates the pumps from the first set of electric pumps with the first pressure level and the pumps from the second set of electric pumps with the second pressure level.

Embodiment #9: The method of Embodiment #8, wherein disabling the electric pumps from the first set of pumps that are not in the second set of electric pumps includes sending a message to the respective pumps notifying the pumps to turn off.

Embodiment #10: The method of Embodiment #8, wherein each pump is connected to a kickout transducer, and wherein enabling the first set of electric pumps includes programming each kickout transducer to disable its respective pump when the pressure level associated with the respective pump in the pressure schedule is reached.

Embodiment #11: A well stimulation system, comprising a plurality of electric pumps; a frac iron configuration having a system pressure sensor and a manifold connected via fluid lines to the plurality of electric pumps; and a computer system connected to the electric pumps and to the manifold, wherein the computer system includes a processor and a memory, wherein the memory includes instructions that, when executed on the processor, pressurize the frac iron configuration with a fluid to perform a leak test, wherein pressurizing includes defining a pressure schedule having first, second and third sets of the electric pumps, wherein the second set is a subset of the first set and the third set is a subset of the second set; enabling the first set of the electric pumps to operate continuously to a first pressure level before disabling the electric pumps in the first set that are not in the second set; automatically operating each of the enabled electric pumps in the second set of electric pumps continuously to a second pressure level before disabling the electric pumps in the second set that are not in the third set; and automatically operating each of the enabled pumps in the third set of electric pumps continuously to a third pressure level.

Embodiment #12: The system of Embodiment #11, wherein the third set of electric pumps includes only one electric pump.

Embodiment #13: The system of Embodiment #11, wherein the instructions for disabling the electric pumps from the second set of pumps that are not in the third set of electric pumps includes testing for a leak in the frac iron configuration and, if a leak is detected, reporting the leak.

Embodiment #14: The system of Embodiment #13, wherein the instructions for reporting a leak include instructions for isolating the leak, wherein the instructions for isolating the leak include the instructions for repressurizing the frac iron configuration to reduce a pressure drop; closing valves in the frac iron configuration to isolate sections of the frac iron configuration; and detecting a leak in one or more of the isolated sections.

Embodiment #15: The system of Embodiment #13, wherein the instructions for reporting a leak include instructions for isolating the leak, wherein isolating the leak includes closing one or more valves to isolate sections of the frac iron configuration; and detecting the isolated leak via sensors attached to each fluid line.

Embodiment #16: The system of Embodiment #12, wherein the pressure schedule details the first and second pressure levels and associates the pumps from the first set of electric pumps with the first pressure level and the pumps from the second set of electric pumps with the second pressure level.

Embodiment #17: The system of Embodiment #12, wherein the instructions for disabling one or more of the pumps include instructions for sending a message to the one or more pumps notifying the respective pumps to turn off.

Embodiment #18: The system of Embodiment #16, wherein each pump is associated with a kickout transducer, and wherein the instructions for enabling the first set of electric pumps includes instructions for programming each kickout transducer to disable its respective pump when the pressure level associated with the respective pump in the pressure schedule is reached.

Embodiment #19. A method for controlling a plurality of pumps configured to pump fluid from a fluid supply to a frac iron configuration having a manifold, the method comprising defining a pressure schedule having a plurality of pressure levels, including a first, second and third pressure level, wherein each pressure level is associated with a predefined pump configuration; and automatically performing a plurality of pressurizing cycles on the frac iron configuration, each of the pressurizing cycles comprising pressurizing the frac iron configuration with a fluid until the fluid in the manifold has reached one of the pressure levels in the pressure schedule; and when the fluid in the manifold has reached one of the pressure levels in the pressure schedule, automatically switching the pumps to the predefined pump configuration associated with the next higher pressure level.

Embodiment #20: The method of Embodiment #19, wherein switching to the pumps to the predefined pump configuration associated with the next higher pressure level includes pausing the pumps associated with the current pressure level; testing for a leak in the frac iron configuration; and enabling the pumps in the predefined pump configuration associated with the next higher pressure level after the pause.

What is claimed is:

1. A method for controlling a plurality of electric pumps configured to pump fluid from a fluid supply to a frac iron configuration, the frac iron configuration including a manifold connected to the electric pumps, the method comprising:

defining a pressure schedule having first and second sets of the electric pumps, wherein the second set is a subset of the first set, wherein the pressure schedule associates a first pressure level with the first set of electric pumps and associates a second pressure level with the second set of electric pumps, wherein the first pressure level is less than the second pressure level;

enabling the first set of electric pumps to pump fluid continuously from the fluid supply to the frac iron configuration until the fluid in the manifold has reached the first pressure level;

automatically disabling the electric pumps from the first set of pumps that are not in the second set of electric pumps after reaching the first pressure level, while allowing the second set of pumps to continue to pump fluid from the fluid supply to the frac iron configuration until the fluid in the manifold has reached the second pressure level; and pressure testing the frac iron configuration at the second pressure level to identify leaks in the frac iron configuration at the second pressure level pressure.

2. The method of claim 1, wherein the pressure schedule has a third set of electric pumps, the third set of electric pumps a subset of the second set of electric pumps, wherein the pressure schedule associates the pumps from the third set of electric pumps with a third pressure level, wherein the second pressure level is less than the third pressure level, the method further comprising:

automatically disabling the electric pumps from the second set of pumps that are not in the third set of electric pumps after reaching the second pressure level, while allowing the third set of pumps to continue to pump fluid from the fluid supply to the frac iron configuration until the fluid in the manifold has reached the third pressure level; and pressure testing the frac iron configuration at the third pressure level to identify leaks in the frac iron configuration at the third pressure level pressure.

3. The method of claim 2, wherein the third set of electric pumps includes only one electric pump.

4. The method of claim 2, wherein disabling the electric pumps from the second set of pumps that are not in the third set of electric pumps includes testing for a leak in the frac iron configuration and, if a leak is detected, reporting the leak.

5. The method of claim 4, wherein reporting a leak includes isolating the leak, wherein isolating the leak includes repressurizing the frac iron configuration to reduce a pressure drop, closing valves in the frac iron configuration to isolate sections of the frac iron configuration and detecting a leak in one or more of the isolated sections.

6. The method of claim 4, wherein reporting a leak includes isolating the leak.

7. The method of claim 6, wherein isolating the leak includes:

closing one or more valves to isolate sections of the frac iron configuration; and detecting a leak in one or more of the isolated sections.

8. The method of claim 4, wherein reporting a leak includes sending a message before continuing to the third pressure level.

9. The method of claim 2, wherein each pump is connected to a kickout transducer, and wherein enabling the first set of electric pumps includes programming each kickout transducer to disable its respective pump when the pressure level associated with the respective pump in the pressure schedule is reached.

10. The method of claim 1, wherein automatically disabling the electric pumps from the first set of pumps that are not in the second set of electric includes sending a message from a processor to the respective pumps notifying the pumps to turn off.

11. A well stimulation system, comprising:

a plurality of electric pumps;

a frac iron configuration having a system pressure sensor and a manifold connected via fluid lines to the plurality of electric pumps; and a computer system connected to the electric pumps and to the manifold, wherein the computer system includes a processor and a memory, wherein the memory includes instructions that, when executed on the processor, pressurize the frac iron configuration with a fluid, wherein pressurizing includes:

defining a pressure schedule having first and second sets of the electric pumps, wherein the second set is a subset of the first set, wherein the pressure schedule associates a first pressure level with the first set of electric pumps and associates a second pressure level with the second set of electric pumps, wherein first pressure level is less than the second pressure level;

enabling the first set of the electric pumps to operate continuously to the first pressure level before disabling the electric pumps in the first set that are not in the second set;

automatically operating each of the enabled electric pumps in the second set of electric pumps continuously to the second pressure level; and pressure testing the frac iron configuration at the second pressure level to identify leaks in the frac iron configuration at the second pressure level pressure.

12. The system of claim 11, wherein the pressure schedule has a third set of electric pumps, the third set of electric pumps a subset of the second set of electric pumps, wherein the pressure schedule associates the pumps from the third set of electric pumps with a third pressure level and wherein the second pressure level is less than the third pressure level, the memory further comprising instructions that, when executed on the processor:

automatically disable the electric pumps from the second set of pumps that are not in the third set of electric pumps after reaching the second pressure level, while allowing the third set of pumps to continue to pump fluid from the fluid supply to the frac iron configuration until the fluid in the manifold has reached the third pressure level; and pressure test the frac iron configuration at the third pressure level to identify leaks in the frac iron configuration at the third pressure level pressure.

13. The system of claim 12, wherein the third set of electric pumps includes only one electric pump.

14. The system of claim 12, wherein the instructions for disabling the electric pumps from the second set of pumps that are not in the third set of electric pumps includes instructions for testing for a leak in the frac iron configuration and, if a leak is detected, reporting the leak.

15. The system of claim 14, wherein the instructions for reporting a leak include instructions for isolating the leak, wherein the instructions for isolating the leak include instructions for:

repressurizing the frac iron configuration to reduce a pressure drop;

closing valves in the frac iron configuration to isolate sections of the frac iron configuration; and detecting a leak in one or more of the isolated sections.

16. The system of claim 14, wherein the instructions for reporting a leak include instructions for isolating the leak, wherein isolating the leak includes:

closing one or more valves to isolate sections of the frac iron configuration; and detecting the isolated leak via sensors attached to each fluid line.

17. The system of claim 11, wherein each pump is associated with a kickout transducer, and wherein the instructions for enabling the first set of electric pumps includes instructions for programming each kickout transducer to disable its respective pump when the pressure level associated with the respective pump in the pressure schedule is reached.

18. The system of claim 11, wherein the instructions for disabling the electric pumps in the first set that are not in the second set include instructions for sending a message from the processor to the one or more of the first set pumps notifying the respective pumps to turn off.

19. A method for controlling a plurality of electric pumps configured to pump fluid from a fluid supply to a frac iron configuration having a manifold, the method comprising:

receiving a pressure schedule having a plurality of pressure levels, wherein each pressure level in the plurality of pressure levels is associated with a predefined pump configuration, wherein each predefined pump configuration includes a subset of the electric pumps in the predefined pump configurations associated with lower pressure levels; and automatically performing a plurality of pressurizing cycles on the frac iron configuration, each of the pressurizing cycles comprising:

pressurizing the frac iron configuration with a fluid until the fluid in the manifold has reached one of the pressure levels in the pressure schedule; and when the fluid in the manifold has reached one of the pressure levels in the pressure schedule, automatically switching the electric pumps to the predefined pump configuration associated with the next higher pressure level.

20. The method of claim 19, wherein automatically switching the electric pumps to the predefined pump configuration associated with the next higher pressure level includes:

testing for a leak in the frac iron configuration; and enabling only the electric pumps from the plurality of electric pumps in the predefined pump configuration associated with the current pressure level that are not also associated with the next higher pressure level with the next higher pressure level.

* * * * *